US008259905B2

(12) United States Patent
Al-Sadah et al.

(10) Patent No.: US 8,259,905 B2
(45) Date of Patent: Sep. 4, 2012

(54) X-RAY TUBE HAVING A ROTATING AND LINEARLY TRANSLATING ANODE

(75) Inventors: Jihad Hassan Al-Sadah, Dhahran (SA); Nabil Maalej, Dhahran (SA); Ezzat Abbas Mansour, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 263 days.

(21) Appl. No.: 12/805,289

(22) Filed: Jul. 22, 2010

(65) Prior Publication Data

US 2010/0290595 A1 Nov. 18, 2010

Related U.S. Application Data

(63) Continuation-in-part of application No. 12/453,655, filed on May 18, 2009, now Pat. No. 7,852,987.

(51) Int. Cl.
*H01J 35/08* (2006.01)

(52) U.S. Cl. ..... 378/126; 378/143

(58) Field of Classification Search ..... 378/119, 378/121, 125, 126, 137, 143, 144
See application file for complete search history.

(56) References Cited

U.S. PATENT DOCUMENTS 1,192,706 A 7/1916 Thomson
1,211,092 A 1/1917 Coolidge
1,621,926 A 3/1927 Fujimoto
1,917,099 A 7/1933 Coolidge
1,946,312 A 2/1934 Coolidge
2,926,270 A 2/1960 Zunick
3,398,307 A 8/1968 Brown et al.
3,646,380 A 2/1972 Hartl
3,836,805 A 9/1974 Kok
4,300,051 A 11/1981 Little
4,399,551 A 8/1983 Grady
4,433,431 A 2/1984 Pfeiler
4,658,414 A 4/1987 Geldner
4,689,809 A 8/1987 Sohval
5,305,363 A 4/1994 Burke et al.
6,522,721 B1 2/2003 Lustberg
6,778,633 B1 8/2004 Loxley et al.
7,012,989 B2 3/2006 Holland et al.
7,248,672 B2 7/2007 Durst et al.
7,305,063 B2 * 12/2007 Heuscher ..... 378/12
7,305,066 B2 12/2007 Ukita
7,315,610 B2 1/2008 Freudenberger et al.

* cited by examiner

*Primary Examiner* — Courtney Thomas
(74) *Attorney, Agent, or Firm* — Richard C. Litman

(57) ABSTRACT

The X-ray tube having a rotating and linearly translating anode includes an evacuated shell having a substantially cylindrical anode rotatably mounted therein. The substantially cylindrical anode may be rotated through the usage of any suitable rotational drive, and the substantially cylindrical anode is further selectively and controllably linearly translatable about the rotating longitudinal axis thereof. A cathode is further mounted within the evacuated shell for producing an electron beam that impinges on an outer surface of the substantially cylindrical anode, thus forming a focal spot thereon. X-rays are generated from the focal spot and are transmitted through an X-ray permeable window formed in the evacuated shell.

15 Claims, 9 Drawing Sheets

X-RAY TUBE HAVING A ROTATING AND LINEARLY TRANSLATING ANODE

CROSS-REFERENCE TO RELATED APPLICATION

This application is a continuation-in-part of U.S. patent application Ser. No. 12/453,655, filed May 18, 2009.

BACKGROUND OF THE INVENTION

1. Field of the Invention

The present invention relates to radiographic equipment, and particularly, to an X-ray tube having a rotating and linearly translating anode.

2. Description of the Related Art

An X-ray tube is a vacuum tube that produces X-rays, typically found in medical X-ray machines and the like. As with any vacuum tube, there is an emitter, typically a filament cathode, which emits electrons into the vacuum, and an anode to collect the electrons, thus establishing a flow of electrical current, referred to as the "beam", through the tube. A high voltage power source, for example 30 to 150 kV), is connected across the cathode and anode to accelerate the electrons. The X-ray spectrum produced depends on the anode material and the accelerating voltage.

Electrons from the cathode collide with a target deposited on the anode, with the target often formed from tungsten, molybdenum or copper. During collisions, the electrons lose energy in both collisional and radiative modes. About 1% of the kinetic energy during the collision process is converted into X-ray radiation. This is due to the deceleration of the electrons within the electrical field of the nucleus, or through the creation of vacancies in the inner shells of bound electrons.

FIG. 2 illustrates a typical, prior art Coolidge X-ray tube 100, also referred to as a "hot cathode tube". The Coolidge tube 100 is a vacuum tube, typically formed from a glass shell 104, having a vacuum formed therein, typically along the order of approximately $10^{-4}$ Pa or $10^{-6}$ Torr. In the Coolidge tube 100, electrons are produced via the thermionic effect from a tungsten filament 102 heated by an electric current (shown in FIG. 2 as being produced by voltage source $V_H$). The filament 102 forms the cathode of the tube 100. A high voltage potential is produced between the cathode and an anode 106 of the tube (produced in FIG. 2 by high voltage source $V_{C-A}$), so that the electrons generated by filament 102 are accelerated toward anode 106, and then strike the anode 106 to produce X-rays X. In FIG. 2, the Coolidge tube 100 is shown as also including a cooling device 108, with a water inlet $W_{in}$ and a water outlet $W_{out}$, for cooling the anode 106, which heats during X-ray production.

Coolidge tubes are formed as either end-window tubes or side-window tubes. In an end-window tube, the filament is wrapped about the anode, so the electrons have a curved path. The tube 100 of FIG. 2 is a side-window tube. In side-window tubes, an electrostatic lens is used to focus the beam onto a very small spot on the anode 106. The anode 106 is specially designed to dissipate the heat and wear resulting from this intense focused barrage of electrons. The anode is precisely angled at between 1 and 20° off perpendicular to the electron current so as to allow escape of some of the X-ray photons X which are emitted essentially perpendicular to the direction of the electron current. The anode is typically made from tungsten or molybdenum. Further, the tube has a window designed for escape of the generated X-ray photons. The input power of a typical Coolidge tube usually ranges from between 1 and 4 kW. Exemplary Coolidge X-ray tubes are shown in U.S. Pat. Nos. 1,211,092; 1,251,388; 1,917,099; and 1,946,312, each of which is hereby incorporated by reference in its entirety.

FIG. 3 illustrates a typical, prior art rotating anode tube 200. The rotating anode tube is an improvement of the Coolidge tube. Because X-ray production is very inefficient (99% of incident energy is converted to heat), the dissipation of heat at the focal spot of the electron beam is one of the main limitations on the power which can be applied. By sweeping the anode past the focal spot, the heat load can be spread over a larger area, greatly increasing the power rating. With the exception of dental X-ray tubes, almost all medical X-ray tubes are of this type.

The rotating anode tube 200 is also a vacuum tube, formed from shell 202 having an X-ray window 210 formed therein. The anode 204 consists of a disc with an annular target 206 formed thereon. The anode disc 204 is supported on an axle 214, which is supported by bearings 212 within the tube shell 202. The anode 204 can then be rotated by electromagnetic induction from a series of stator windings outside the evacuated tube.

Because the entire anode assembly has to be contained within the evacuated tube shell 202, heat removal is a serious problem, further exacerbated by the higher power rating available. Direct cooling by conduction or convection, as in the Coolidge tube, is difficult. In most tubes, the anode 204 is suspended on ball bearings with silver powder lubrication, which provides almost negligible cooling by conduction.

The anode 204 must be constructed of high temperature materials. The focal spot temperature caused by electrons generated by cathode 208 impinging upon target 206 can reach 2500° C. during an exposure, and the anode assembly can reach 1000° C. following a series of large exposures. Typical materials used to form the anode are a tungsten-rhenium target 206 on a molybdenum core, backed with graphite. The rhenium makes the tungsten more ductile and resistant to wear from impact of the electron beams. The molybdenum conducts heat from the target. The graphite provides thermal storage for the anode, and minimizes the rotating mass of the anode.

Increasing demand for high-performance CT scanning and angiography systems has driven development of very high performance medical X-ray tubes. Contemporary CT tubes have power ratings of up to 100 kW and anode heat capacity of 6 MJ, yet retain an effective focal spot area of less than 1 $mm^2$. Exemplary rotating anode X-ray tubes are shown in U.S. Pat. Nos. 1,192,706; 1,621,926; and 3,646,380, each of which is hereby incorporated by reference in its entirety.

In typical X-ray tubes, such as those described above, approximately 1% of the energy of the electron beam is converted to useful X-ray radiation, with 99% of the energy being lost as thermal energy. Thermal loss is of particular importance in high definition imaging, in which the electron beam must be focused on as small a target area as possible over a time period that is as short as possible. Image resolution depends upon both factors in diagnostic X-ray systems. Thermal energy gain within the target is a serious obstacle to the reduction of electron beam size or shortened exposure time.

Excess heat may be removed via conduction, as described above with reference to Coolidge tube 100, or the problem of instantaneous heating may be at least partially controlled by rotating the anode, as in rotating anode tube 200. Such solutions, however, only offer one degree of freedom in heat spreading. It would be desirable to provide an X-ray tube that can provide two degrees of freedom of heat dissipation, allowing for much higher instantaneous power limits.

Thus, an X-ray tube having a rotating and linearly translating anode solving the aforementioned problems is desired.

SUMMARY OF THE INVENTION

The X-ray tube having a rotating and linearly translating anode includes an evacuated shell having a substantially cylindrical anode rotatably mounted therein. The substantially cylindrical anode may be rotated through the use of any suitable rotational drive, and the substantially cylindrical anode is further selectively and controllably linearly translatable about the rotating longitudinal axis thereof. A cathode is mounted within the evacuated shell for producing an electron beam that impinges on an outer surface of the substantially cylindrical anode, thus forming a focal spot thereon. X-rays are generated from the focal spot and are transmitted through an X-ray permeable window formed in the evacuated shell.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
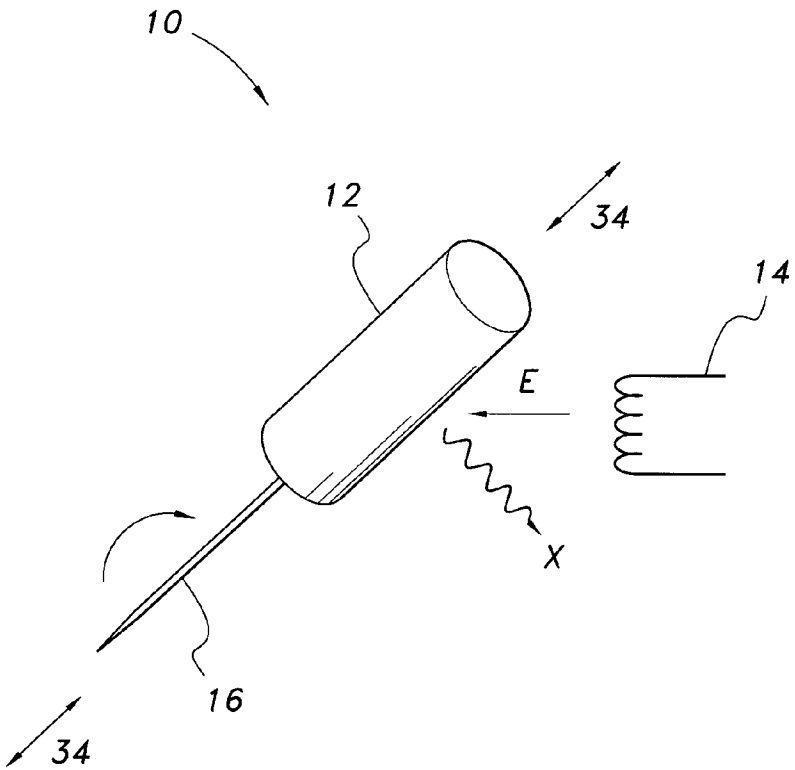
FIG. 1 is a simplified, diagrammatic view of an X-ray tube having a rotating and linearly translating anode according to the present invention.
Figure 2:
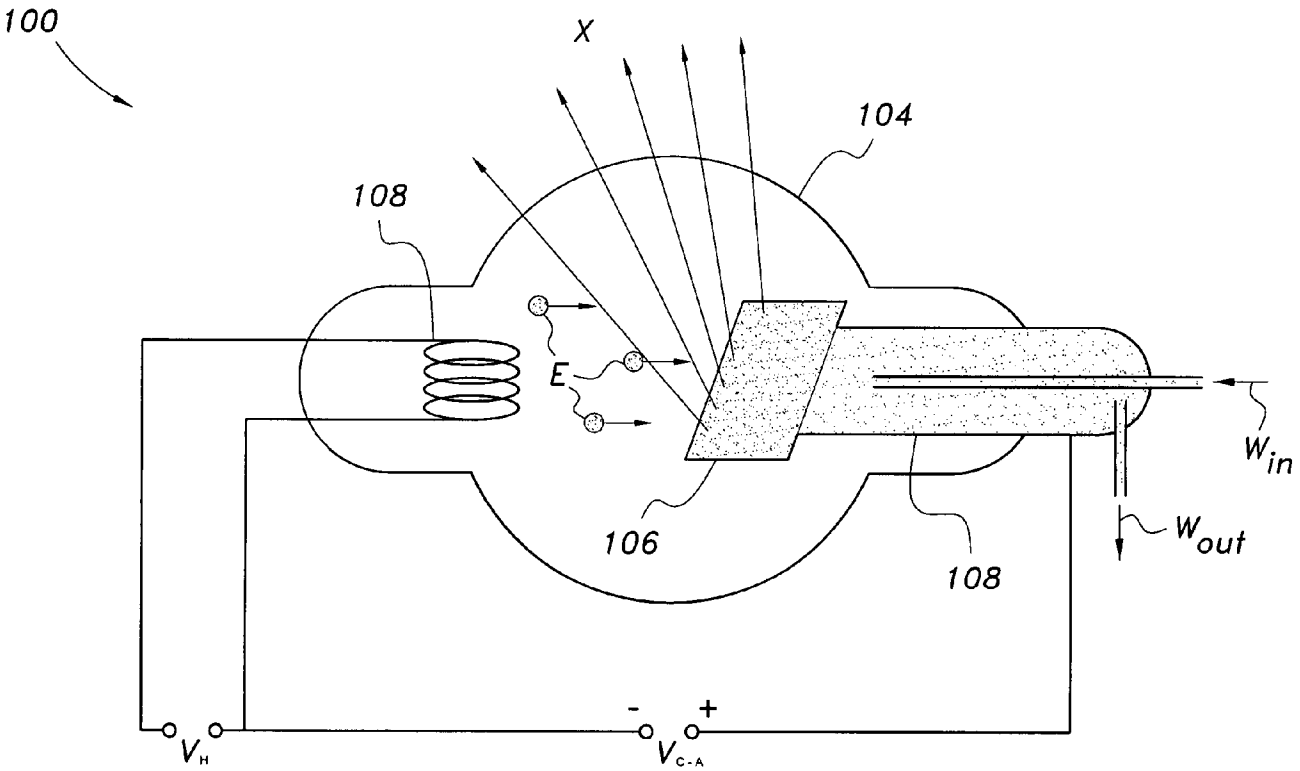
FIG. 2 PRIOR ART
FIG. 2 is a diagrammatic view of a prior art Coolidge X-ray tube.

Now referring to FIG. 1, an X-ray tube having a rotating and linearly translating anode is designated generally as 10. The X-ray tube 10 operates in a manner similar to Coolidge tube 100 of FIG. 2 and the rotating anode tube 200 of FIG. 3. Although shown diagrammatically, it should be understood that the tube 10 includes the conventional evacuated shell, high voltage power source, etc. described above with reference to tubes 100, 200. The exemplary X-ray tubes described above in U.S. Pat. Nos. 1,211,092; 1,251,388; 1,917,099; 1,946,312; 1,192,706; 1,621,926; and 3,646,380 are all hereby incorporated by reference in their entireties.

Figure 3:
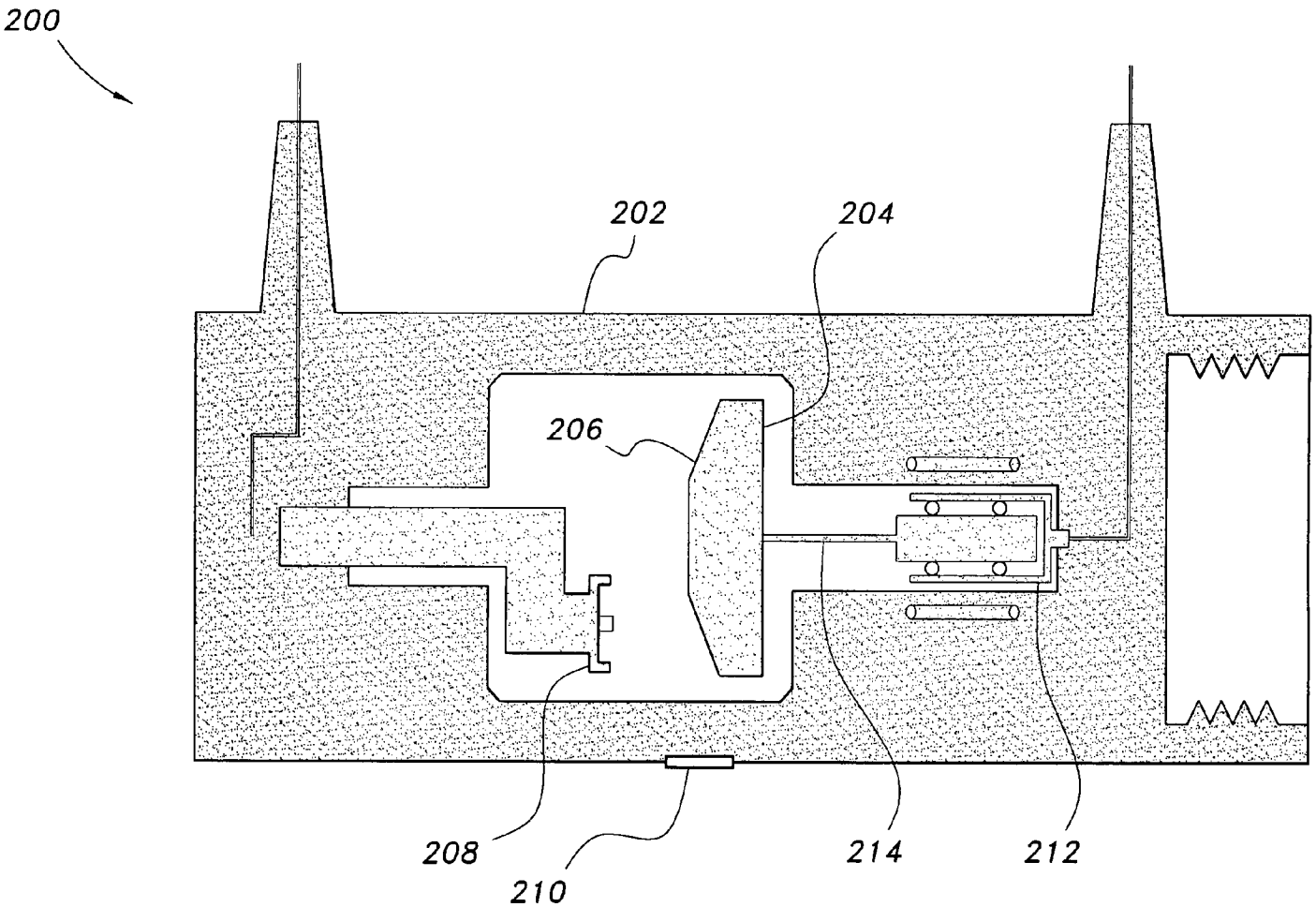
FIG. 3 PRIOR ART
FIG. 3 is a diagrammatic view of a prior art rotating anode X-ray tube.

As shown, tube 10 includes a cathode 14 that emits an electron beam E. Electron beam E impinges upon anode 12 to form X-rays X. Anode 12 is mounted on a rotating shaft 16, as in the prior art rotating anode tube 200. As shown in FIG. 3, a typical anode in a rotating anode tube is formed having a substantially frustoconical shape. Preferably, anode 12 of tube 10 has a cylindrical shape. The cylindrical shape of anode 12 allows for easier and more efficient adjustment and control over the angle of incidence between the target surface of anode 12 and the electron beam E. X-ray generation utilizing an anode that is both rotatable and linearly translatable is known. One such system is shown in U.S. Pat. No. 3,836,805, which is herein incorporated by reference in its entirety. This reference, however, teaches the usage of a hollow anode shell, which is necessary due to the inclusion of a temperature sensor. However, as best shown in FIG. 1, anode 12 preferably is formed as a solid cylinder that is coaxial with the axis of rotation. By forming the anode as a solid piece, anode 12 has a greater heat capacity than that found in shell-type anodes.

Figure 5:
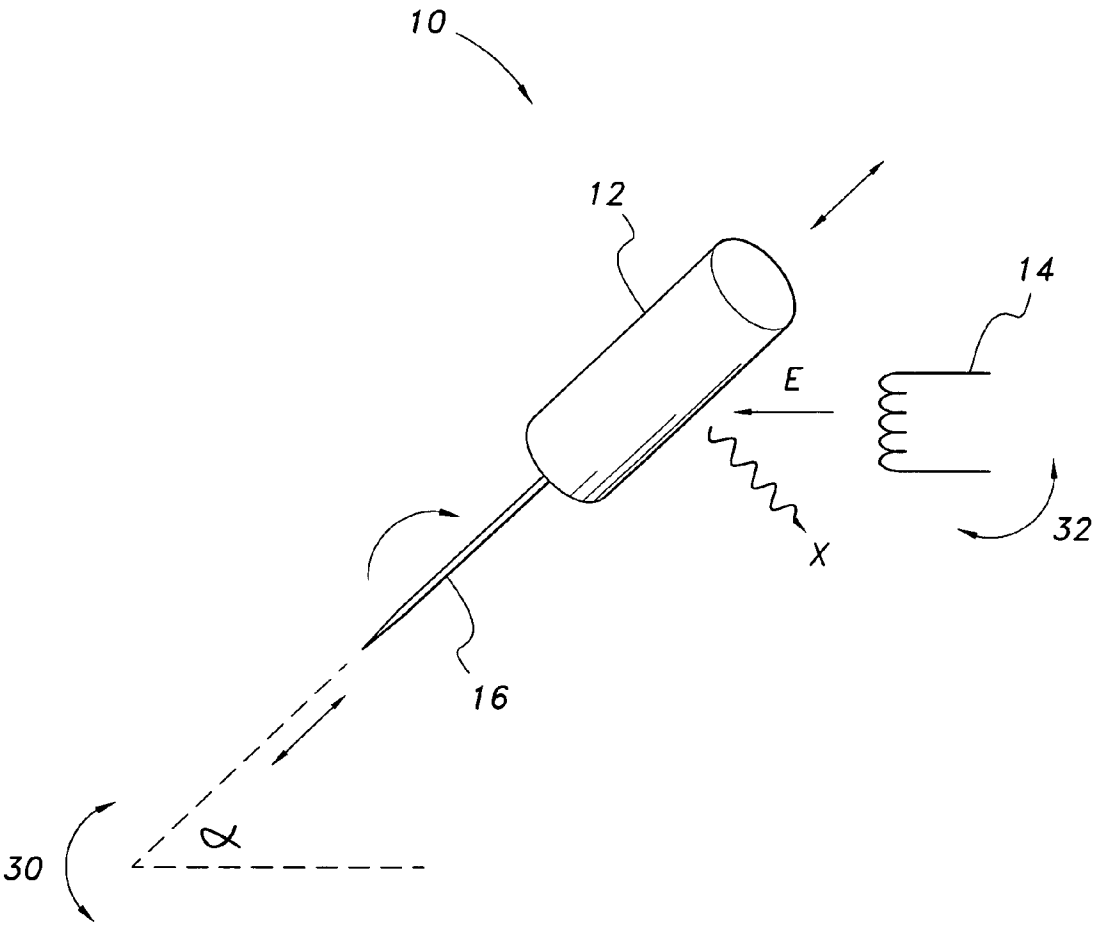
FIG. 5 is a simplified, diagrammatic view of another alternative embodiment of an X-ray tube having a rotating and linearly translating anode according to the present invention.

As best shown in FIG. 5, the shaft 16 is positioned at an angle $\alpha$ with respect to the horizontal. As indicated by the directional arrow 30, shaft 16 may preferably be rotated, allowing angle $\alpha$ to be selectively controlled by the user. Shaft 16 may be attached to any suitable motor or other rotating device, allowing the user to control the angle of incidence of the beam. Alternatively, as indicated by directional arrows 32, the cathode 14 may be similarly mounted on any suitable rotating structure to selectively control the angle of electron beam incidence. This rotation further allows for user control over effective focal spot size, power loading and field coverage. The focal spot size may be further controlled through the addition of electrostatic or magnetic lenses.

Returning to FIG. 1, in addition to rotation about the axis of shaft 16, the cylindrical anode 12 may also be linearly translated along the direction of the axis of shaft 16 (indicated by arrows 34). In the rotating anode 204 of prior art tube 200, the electron beam strikes only along an annular path, thus causing heating and loss of target material along this singular, circular path. Minor electrostatic selection of a neighboring annular path is used for material selection rather than for heat dissipation. Further, this method requires additional image processing to account for changes of the physical position of the focal spot.

In tube 10, the anode 12 is both rotated and linearly translated, thus allowing for heat dissipation and target impingement along a significantly larger portion of the surface of the anode 12. With such controlled rotation and translation, the relative lifetime of the anode 12 is increased, the scan time is decreased, and the focal spot size may also be decreased. The shaft 16 may be driven to selectively and controllably rotate via connection to any suitable source of rotational power, such as a controllable motor or the rotating system described with reference to tube 200 of FIG. 3. The shaft 16 may also be driven to linearly translate along its axis in either direction in a controllable manner via mounting on any suitable source of linear motion, such as a controllable linear actuator or the like, or by means for translating rotational motion into linear motion, as is well-known in the art of sewing machines.

Figure 4:
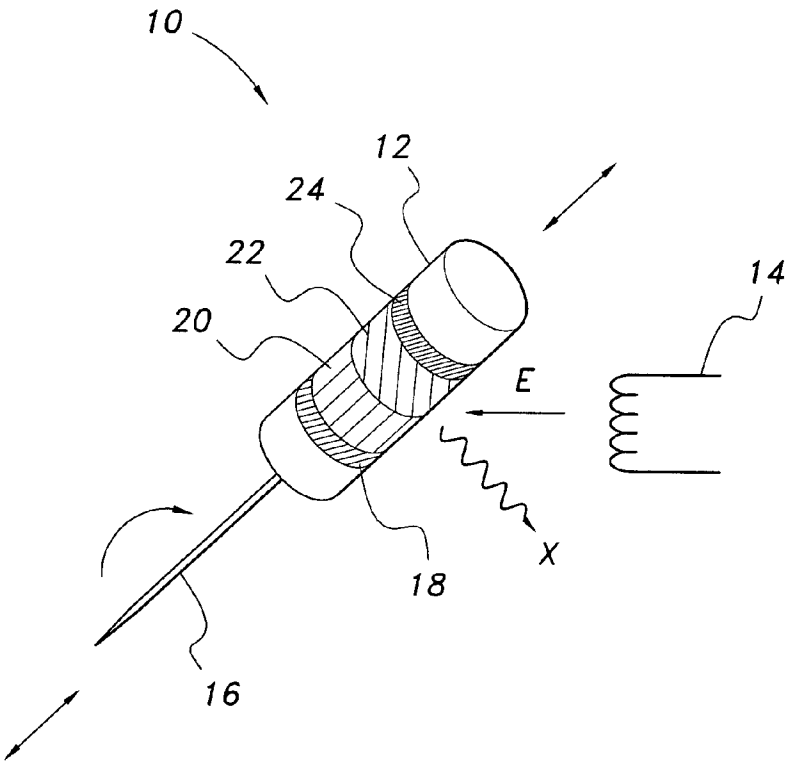
FIG. 4 is a simplified, diagrammatic view of an alternative embodiment of an X-ray tube having a rotating and linearly translating anode according to the present invention.

As a further alternative, multiple bands of differing target materials may be formed on the surface of anode 12. In FIG. 4, four such exemplary bands 18, 20, 22, 24 are shown, although it should be understood that any desired number of bands having any desired thickness and dimensions may be applied. By linearly translating the anode 12, as described above, the user may select the target material to be struck by electron beam E, thus being able to control the frequency and intensity of X-rays X being produced.

Figure 6:
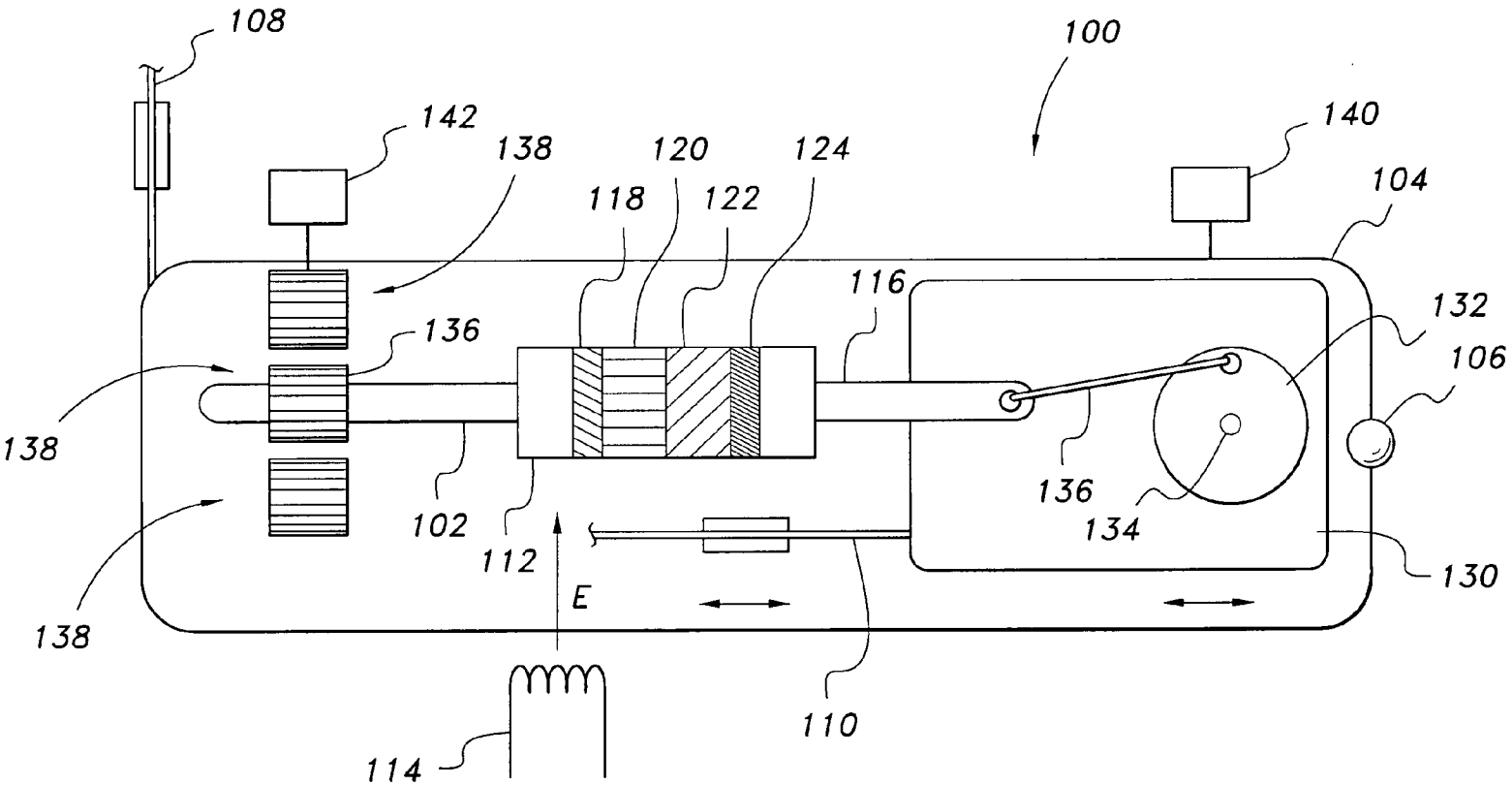
FIG. 6 is a diagrammatic view of yet another alternative embodiment of the X-ray tube having a rotating and linearly translating anode.

As noted above, anode 12 may be rotated, linearly translated and angled by use of any suitable type of actuator or the like. FIG. 6 illustrates an alternative embodiment of an X-ray tube 100 having a rotating and linearly translating anode, the drawing showing a particular means for translating and angling the anode 112. The anode 112 is similar to the cylindrical anode 12 of FIG. 4, including four exemplary bands of differing target materials 118, 120, 122, 124. As in FIG. 4, it should be understood that any desired number of bands having any desired thickness (axial length) and dimensions may be applied to the anode 112. Preferably, the bands 118, 120, 122, 124 each have a relatively substantial thickness (axial length) on the order of approximately one to five centimeters (measured axially) so that minor adjustment of the setting of cathode the 114 (such as electrostatic deflection) is not sufficient to accidentally select a different band.

As shown, the anode 112 has a pair of axial shafts 102, 116 extending from either end. The free end of the axial shaft 116 is slidably mounted on a plate 130. Linear translation of the shaft 116, which causes linear translation of anode 112 (similar to the linear translation of anode 12 shown in FIG. 1, indicated by arrows 34), may be generated by any suitable type of linear actuator or the like mounted on the plate 130. In FIG. 6, a rotating disc 132 is secured to the plate 130 about a driven shaft 134 for driving reciprocating linear displacement of the shaft 116 by interconnection through crank shaft 136. Disc 132 may be driven to rotate by any suitable motor 140 or the like, using any suitable type of drive. It should be understood that any suitable type of linear actuator or the like may be used to controllably and selectively drive linear translation of anode 112 with respect to plate 130.

Plate 130 is slidably mounted within a frame 104. A shaft 110 is fixed at one end to plate 130. The shaft 110 may be manually or otherwise driven to selectively and controllably slide the plate 130 relative to the frame 104. By linearly translating the plate 130 with respect to the frame 104 (thus also further linearly translating anode 112), the user may select the target material to be struck by the electron beam E, thus being able to control the frequency and intensity of X-rays being produced (as described above with respect to FIG. 4). It should be understood that any suitable type of linear actuator or the like may be used to controllably and selectively drive linear translation of the plate 130 relative to the frame 104.

The frame 104 may be mounted within the X-ray tube by a bearing 106 or other pivotal or rotational mount, allowing the frame 106 to be selectively rotated at an angle relative to horizontal. A shaft 108 is fixed to the frame 104, and the shaft 108 may be manually or otherwise driven to selectively and controllably rotate the frame 104 about the bearing 106 in order to selectively adjust the angle between the axis of cylindrical anode 112 and horizontal (as described above with reference to FIG. 5). It should be understood that any suitable type of actuator or the like may be used to controllably and selectively drive angular translation of the frame 104 about the bearing 106.

Additionally, a gear 136 is preferably mounted on the shaft 102, allowing the shaft 102 to be driven to rotate via gears 138, mounted on frame 104. As shown, multiple gears 138 may be mounted on the frame 104, thus allowing the user to rotate the anode 112 about the longitudinal axis of the anode 112. Gears 138 may be driven by any suitable type of motor 142 or the like that provides selective and controllable rotation of anode 112 about the cylindrical axis thereof, as described above with respect to FIG. 1.

Figure 7:
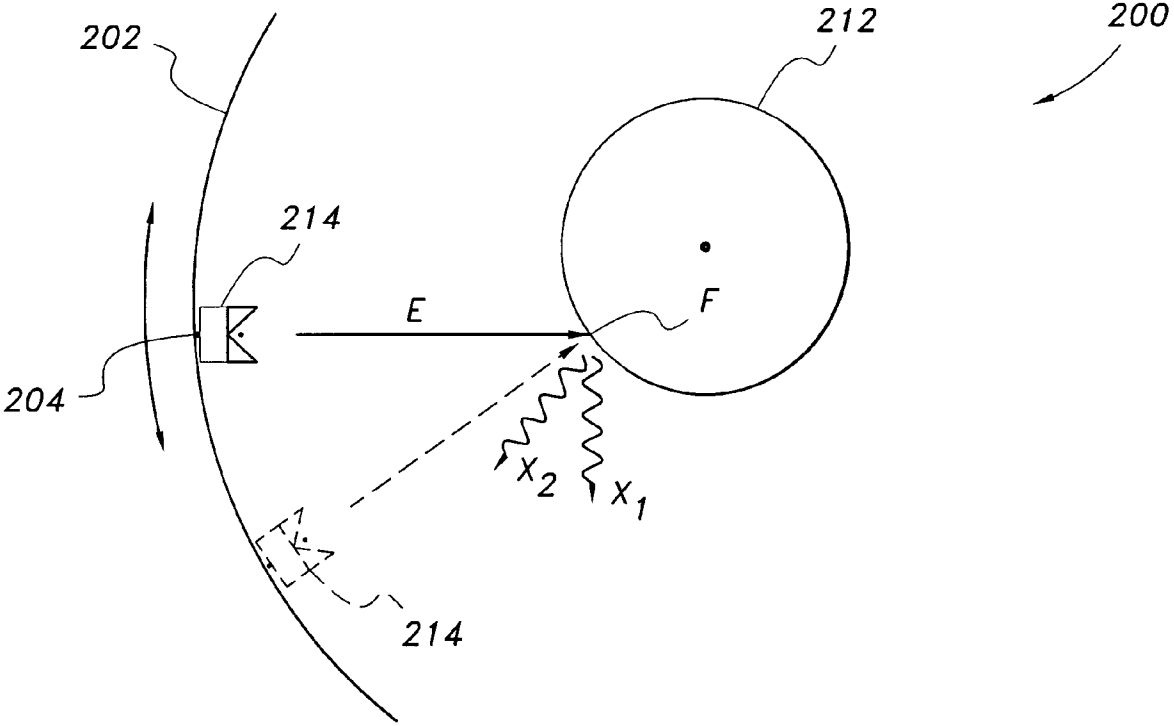
FIG. 7 is a diagrammatic view of an alternative configuration of an X-ray tube having a rotating and linearly translating anode according to the present invention in which the cathode is rotated while keeping the focal point stationary.

FIG. 7 diagrammatically illustrates a configuration of an X-ray tube 200 having a rotating and linearly translating anode that has an alternative orientation of the cathode 214 with respect to the anode 212. As opposed to the X-ray tube having a rotating and linearly translating anode 10, in which rotation about shaft the 16 causes the electron beam E to scan about the circumference of the anode 12, the cathode 214 is mounted to a rotating rail 202, the cathode 214 being pivotally attached to the rail 202 by a pivot pin 204 or the like, thus allowing the electron beam E to strike a constant focal point F on the surface of the anode 212, even under rotation.

This orientation allows a wider range or spread of X-rays to be generated. In FIG. 7, the initial position of the cathode 214 causes generation of X-rays $X_1$. As the cathode 214 is rotated to the lower position (in the orientation of FIG. 7, illustrated in phantom), the cathode 214 is pivoted to keep the electron beam focused on the same focal point, so that the X-rays sweep to the X-ray angle illustrated by X-rays $X_2$. This sweep of the X-ray angle provides a further degree of control over anode angle with respect to the cathode.

Figure 9:
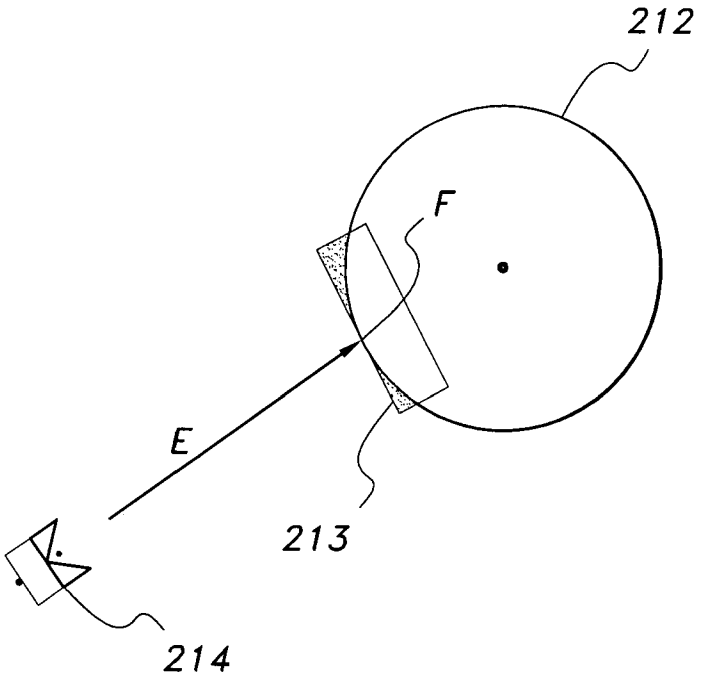
FIG. 9 is a diagrammatic illustration representing the geometry of axial positioning in a cylindrical anode system.

As opposed to a typical CT scanner, for example, the arrangement of FIG. 7 allows the axis of the anode 212 to be positioned horizontally, but normal to the superior-inferior axis of the patient (in contradistinction to a typical CT scanner, in which the axis of the anode is parallel to the superior-inferior axis of the patient). This is best illustrated in FIG. 9, where 213 represents the extra material on cylinder 212, causing the "heel" effect along the superior-inferior axis. The ability to vary the anode angle provides control over the heel effect, accommodating certain scanning procedures, such as that described above, which make use of such an effect.

The curved surface of the cylinder 212 provides for a reduced heel effect, compared with a flat surface. Thus, the flat surface of the cylinder is maintained in a horizontal position. The anode angle (projected onto the curved surface) is controllably varied via a system such as that shown in FIG. 7, or by the alternative system illustrated in FIG. 8.

Figure 8:
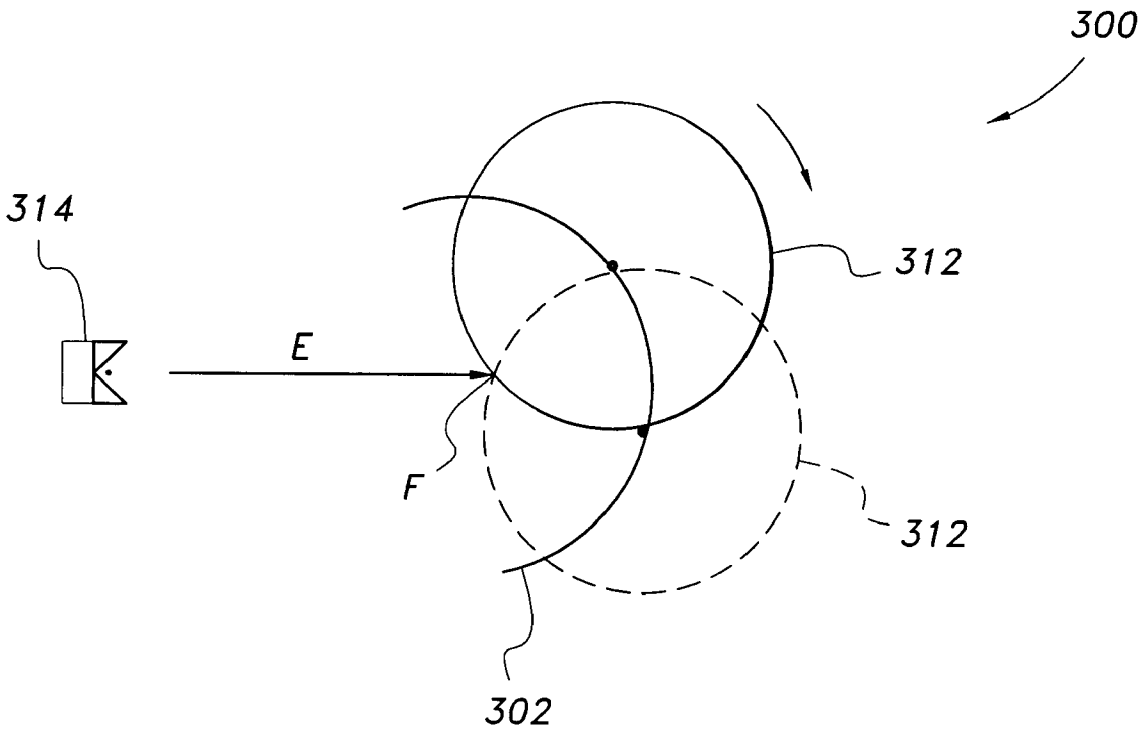
FIG. 8 is a diagrammatic view of an alternative configuration of an X-ray tube having a rotating and linearly translating anode according to the present invention in which the focal point remains stationary while the anode is rotated around the focal point.

FIG. 8 illustrates a configuration of an X-ray tube 300 having a rotating and linearly translating anode that provides a similar effect. However, in this configuration, the anode 312 is mounted on a rotating rail 302, and the anode 312 also rotates about its axis relative to the rail 302. The cathode 314 is fixed, thus allowing the electron beam E to strike at a constant focal point F.

It is to be understood that the present invention is not limited to the embodiments described above, but encompasses any and all embodiments within the scope of the following claims.

We claim:

1. An X-ray tube, comprising:

an evacuated shell having an X-ray permeable window formed therein;

a frame pivotally mounted within the evacuated shell;

a substantially cylindrical, solid anode rotatably mounted on the frame within the evacuated shell, the anode defining a longitudinal axis;

means for selectively rotating the frame with respect to the evacuated shell, the longitudinal axis of the substantially cylindrical anode being selectively adjustable at an angle relative to horizontal;

means for rotating the anode about the longitudinal axis thereof;

means for selectively and controllably translating the anode linearly along the longitudinal axis;

a cathode selectively producing an electron beam incident on an outer surface of the anode, forming a focal spot thereon, so that X-rays are generated therefrom and are transmitted through the X-ray permeable window formed in the evacuated shell.

2. The X-ray tube as recited in claim 1, further comprising means for angularly adjusting said cathode with respect to the longitudinal axis of said substantially cylindrical anode.

3. The X-ray tube as recited in claim 2, further comprising means for focusing the electron beam on a constant focal point on the outer surface of the anode.

4. The X-ray tube as recited in claim 1, further comprising at least two different target materials formed on the outer surface of said substantially cylindrical anode, each of the target materials forming an annular band on the outer surface of said cylindrical anode.

5. The X-ray tube as recited in claim 4, wherein each said annular band has an axial length between approximately one and five centimeters.

6. The X-ray tube as recited in claim 5, further comprising target selection means linearly translating said substantially cylindrical anode for selectively positioning a selected one of said annular bands relative to said cathode so that the electron beam is incident upon the selected one of said annular bands.

7. The X-ray tube as recited in claim 1, wherein said means for selectively and controllably translating the anode along the longitudinal axis comprises means for translating rotational motion into linear motion.

8. An X-ray tube, comprising:

an evacuated shell having an X-ray permeable window formed therein;

a frame pivotally mounted within the evacuated shell;

a substantially cylindrical, solid anode rotatably mounted on the frame within the evacuated shell, the anode defining a longitudinal axis;

at least two different target materials formed on the outer surface of the substantially cylindrical anode, each of the target materials forming an annular band thereon;

means for selectively rotating the frame relative to the evacuated shell, the longitudinal axis of the substantially cylindrical anode being selectively adjustable at an angle relative to horizontal;

means for rotating the anode about the longitudinal axis thereof;

means for selectively and controllably translating the anode linearly along the longitudinal axis;

a cathode selectively producing an electron beam incident on an outer surface of the anode, forming a focal spot thereon, so that X-rays are generated therefrom and are transmitted through the X-ray permeable window formed in the evacuated shell.

9. The X-ray tube as recited in claim 8, further comprising means for angularly adjusting said cathode relative to the longitudinal axis of said substantially cylindrical anode.

10. The X-ray tube as recited in claim 9, further comprising means for focusing the electron beam on a constant focal point on the outer surface of the anode.

11. The X-ray tube as recited in claim 8, wherein each said annular band has an axial length between approximately one and five centimeters.

12. The X-ray tube as recited in claim 11, further comprising target selection means linearly translating said substantially cylindrical anode for selectively positioning a selected one of said annular bands relative to said cathode so that the electron beam is incident upon the selected one of said annular bands.

13. The X-ray tube as recited in claim 12, further comprising first and second shafts coaxially extending from opposed ends of said substantially cylindrical, solid anode.

14. The X-ray tube as recited in claim 13, further comprising a plate slidably mounted to said frame, a free end of the first shaft being attached to the plate.

15. The X-ray tube as recited in claim 14, wherein said means for selectively and controllably translating the anode along the longitudinal axis comprises means for translating rotational motion into linear motion.

* * * * *